United States Patent [19]

Checkley

[11] 4,300,380

[45] Nov. 17, 1981

[54] APPARATUS AND A METHOD FOR USE IN MAKING A RAILWAY RAIL-FASTENING CLIP

[75] Inventor: Peter E. Checkley, Upton-upon-Severn, England

[73] Assignee: Pandrol Limited, London, England

[21] Appl. No.: 143,868

[22] Filed: Apr. 25, 1980

Related U.S. Application Data

[63] Continuation of Ser. No. 951,608, Oct. 13, 1978, abandoned.

[51] Int. Cl.[3] ..... B21D 7/02

[52] U.S. Cl. ..... 72/306; 59/27; 72/217; 72/316; 72/372; 72/404

[58] Field of Search ..... 72/403, 404, 380, 381, 72/383, 384, 386, 316, 217, 306, 372; 59/27, 23, 10, 12, 16, 18, 22, 24, 35; 238/349

[56] References Cited

U.S. PATENT DOCUMENTS

| | | | |
|---|---|---|---|
| 253,390 | 2/1882 | Johnston | 59/23 |
| 459,401 | 9/1891 | Johnson | 59/23 |
| 803,988 | 11/1905 | Carter | 59/23 |
| 1,682,149 | 8/1928 | Robertson . | |
| 2,343,083 | 2/1944 | Proctor | 29/34 |
| 3,342,029 | 9/1967 | Campbell | 59/18 |
| 3,374,532 | 3/1968 | Zenhausern | 29/505 |
| 4,048,839 | 9/1977 | Peterpaul | 72/412 |
| 4,050,284 | 9/1977 | Miller | 72/404 |
| 4,074,518 | 2/1978 | Taubert | 59/91 |
| 4,123,899 | 11/1978 | Windelbandt | 59/27 |

FOREIGN PATENT DOCUMENTS

| | | |
|---|---|---|
| 383620 | 10/1923 | Fed. Rep. of Germany . |
| 2310168 | 12/1976 | France . |
| 297650 | 9/1928 | United Kingdom . |
| 765364 | 1/1957 | United Kingdom . |
| 841974 | 7/1960 | United Kingdom . |
| 874503 | 8/1961 | United Kingdom . |
| 1298666 | 12/1972 | United Kingdom . |
| 1435033 | 5/1976 | United Kingdom . |

*Primary Examiner*—Gene P. Crosby
*Attorney, Agent, or Firm*—Norbert P. Holler

[57] ABSTRACT

Part of a red-hot metal rod between the ends of the rod is supported and first and second bending members are displaced, preferably simultaneously, to bend parts of the rod on both sides of said part around respective forming surfaces to produce two U-bends substantially without movement of said part. Then the two end portions of the rod point in substantially opposite directions and overlap without touching one another. Preferably the rod bent in this way, still red-hot, proceeds to another location where it is bent further to produce a railway rail-fastening clip of the desired final shape.

20 Claims, 10 Drawing Figures

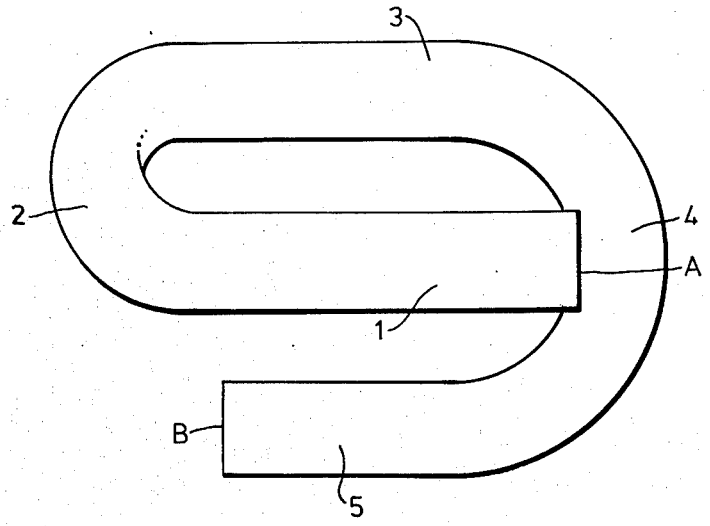
-FIG 1-
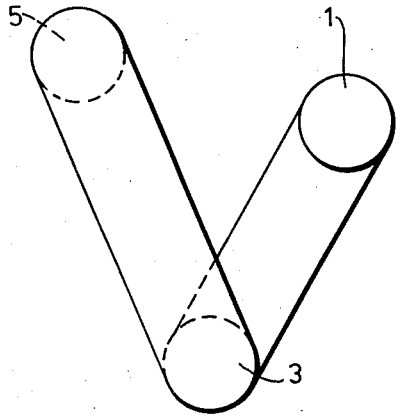
-FIG. 2-

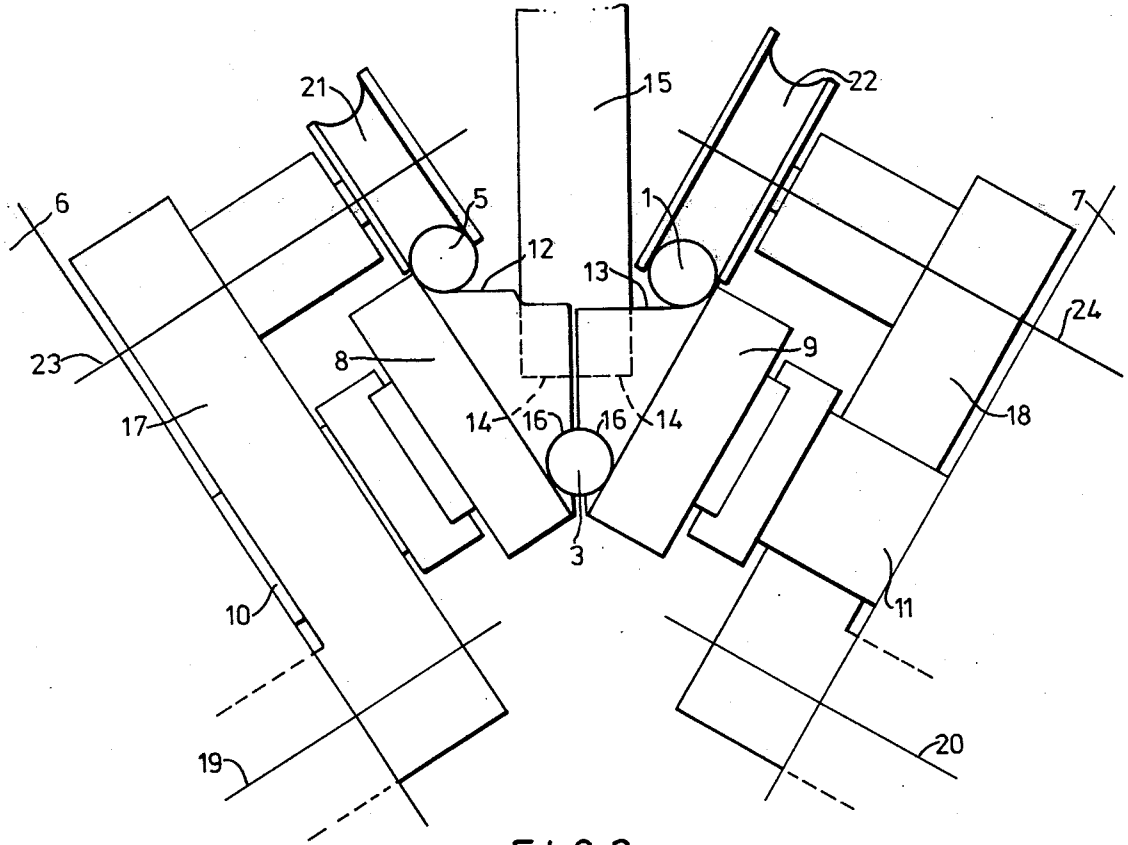
—FIG. 3.—

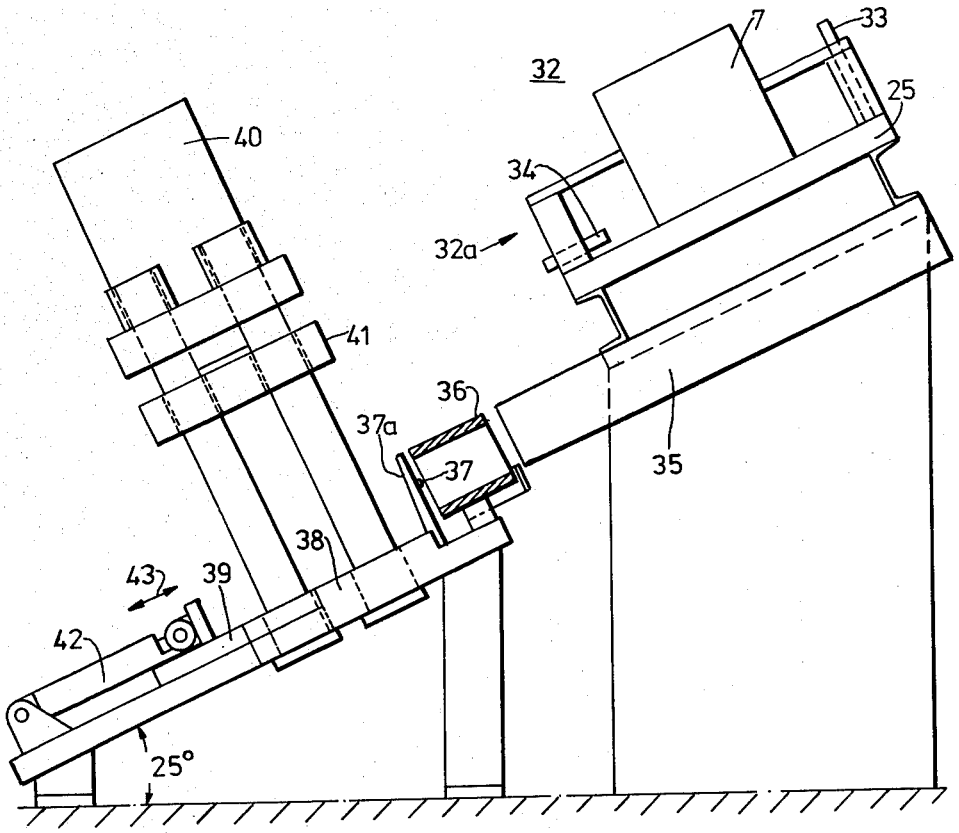
-FIG.6.-

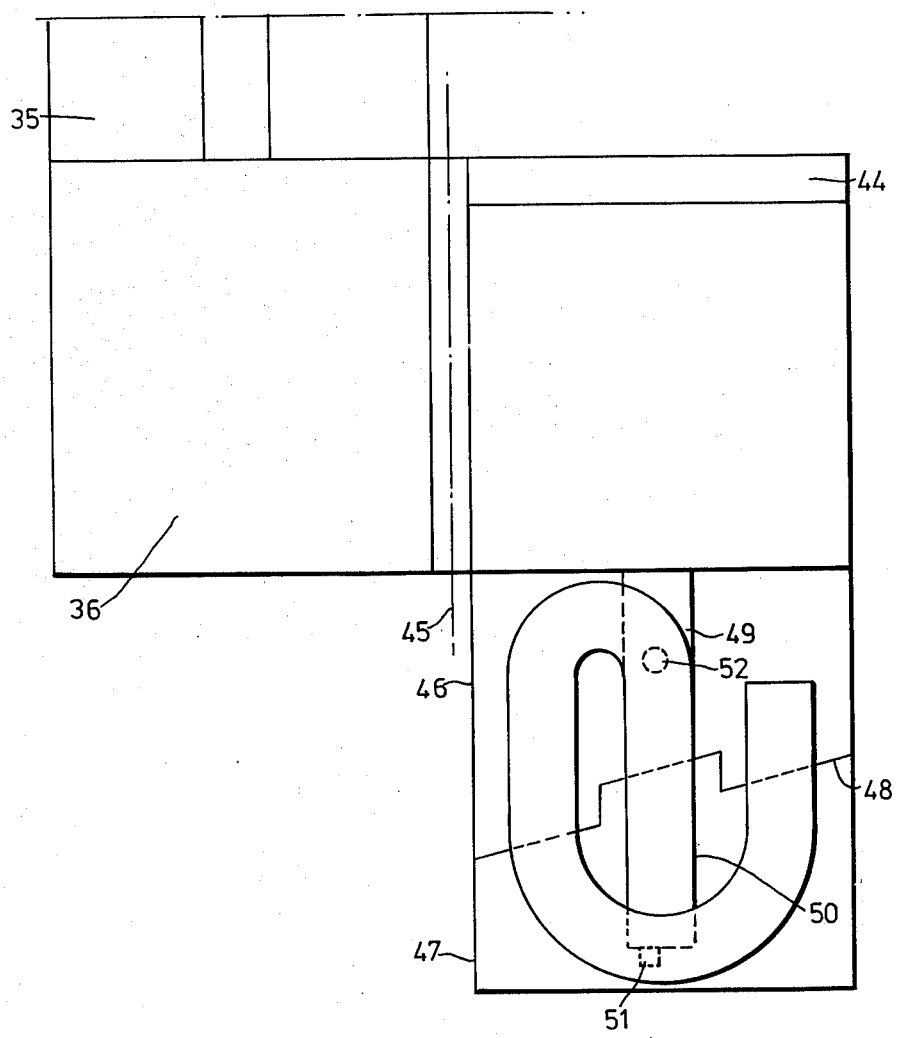
—FIG. 7.—

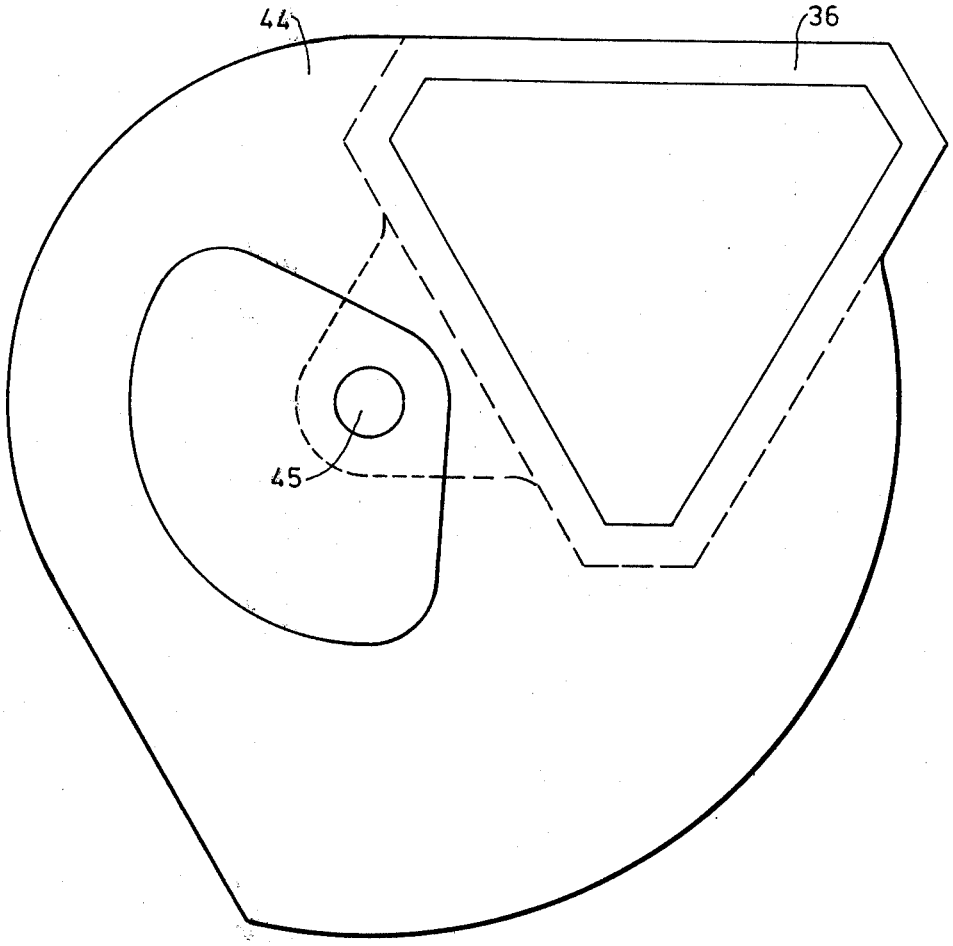
—FIG.8.—

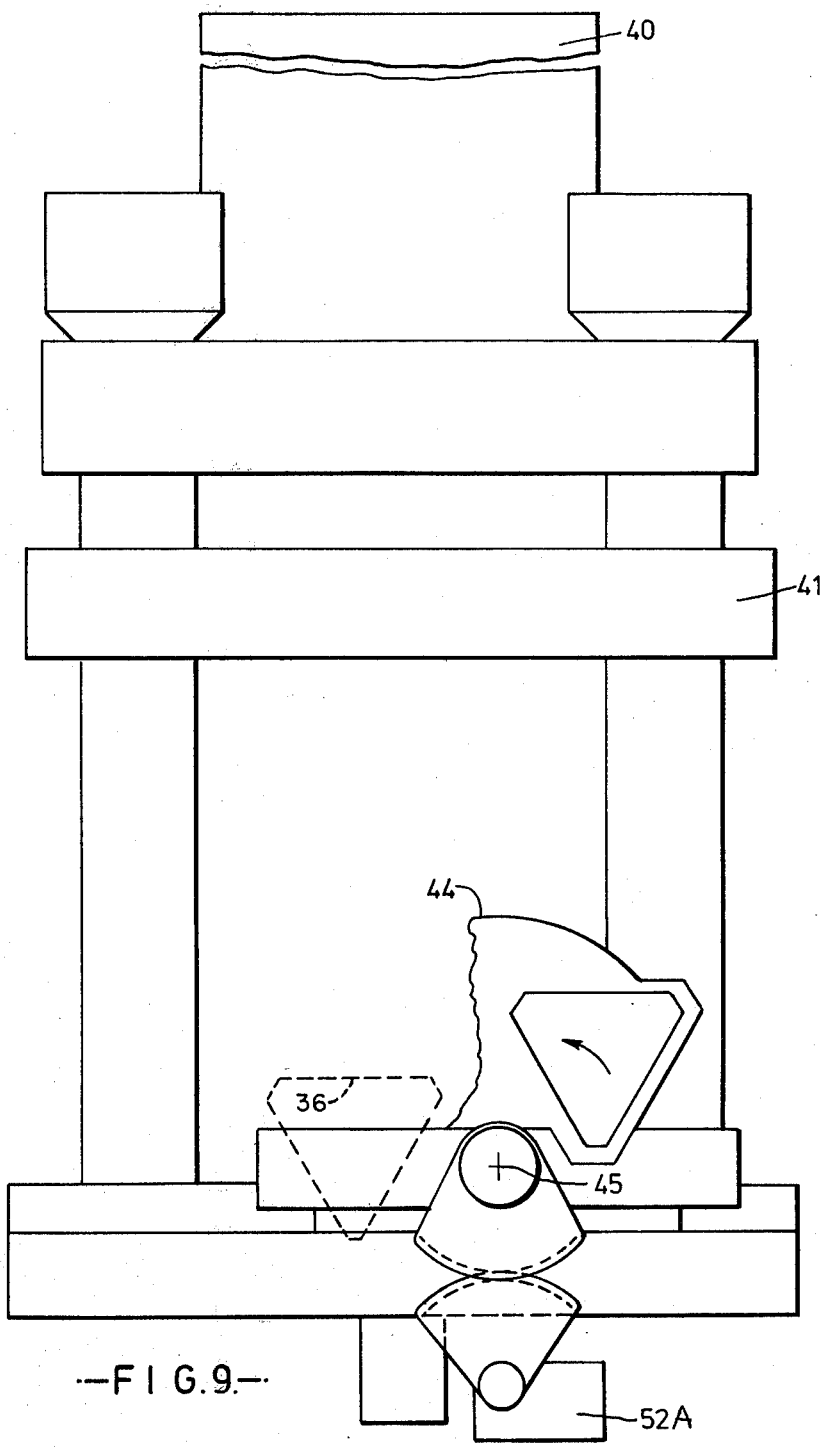
—FIG. 9.—

APPARATUS AND A METHOD FOR USE IN MAKING A RAILWAY RAIL-FASTENING CLIP

This is a continuation of application Ser. No. 951,608, filed Oct. 13, 1978, now abandoned.

This invention relates to apparatus and a method for use in making a railway rail-fastening clip.

According to one aspect of the invention, there is provided apparatus for use in making railway rail-fastening clips comprising support means capable of supporting a part of a red-hot metal rod, which part is between the ends of the rod, first and second supports, first and second members mounted on the first and second supports, respectively, first and second forming surfaces on the first and second members, respectively first and second displaceable bending members mounted on the first and second supports, respectively, means for displacing the bending members relative to the first and second forming surfaces, respectively, so that they bend the parts of the rod on both sides of said part about the first and second forming surfaces respectively, and produce two U-bends in the rod, substantially without movement of said part of the rod, with the result that the end portions of the rod point in substantially opposite directions and overlap without touching one another and means for producing relative motion between the supports so that they come apart to allow the bend rod to move away from the zone in which it was bent.

According to another aspect of the invention, there is provided a method of making a railway rail-fastening clip including supporting a part of a red-hot metal rod, which part is between the ends of the rod, and displacing first and second bending members relative to first and second forming surfaces, respectively, so that they bend the parts of the rod on both sides of said part about said first and second forming surfaces, respectively, substantially without movement of said part of the rod, with the result that two U-bends are formed in the rod, said part remaining substantially straight and constituting one limb of each U, the other limb of at least one of the U's preferably being substantially straight and substantially parallel to said part, and the end portions of the rod point in substantially opposite directions and overlap without touching one another and are spaced apart laterally by a distance greater than the thickness of the rod and are spaced apart laterally by a distance greater than the thickness of the rod.

Preferably, the bending members are displaced as aforesaid simultaneously.

The bent rod, when in a particular orientation and viewed in a particular direction, could look somewhat V-shaped, that is to say each U-bend could lie in a respective plane, the two planes being inclined to one another by an angle between 25° and 95°, for example 65°. In one orientation and from one viewing point it could look rather like a letter e or a mirror image of a letter e. The bent rod could be such that a plane perpendicularly intersecting the middle of said part of the rod intersects said parts of the rod on both sides of said part.

In the method according to the invention, preferably the first and second forming surfaces are on two separate members at least one of which is, and preferably both of which are, movable away from the other to allow the bent rod to fall, or otherwise be displaced, away from the zone in which it was bent. The two members could be mounted on separate carriages provided with means for moving them apart, the carriages also carrying the displaceable bending members, which could be rollers, for example, and could be mounted on the free ends of arms, preferably substantially C-shaped, which are mounted for rotation at their other ends.

There is preferably, near the apparatus described above (called below a first apparatus), a second apparatus for performing a second bending operation on the rod. The second apparatus may be lower than the first apparatus and the installation comprising the first apparatus and the second apparatus may be such that the bent rod can travel between the two under the force of gravity. The second apparatus may comprise supporting means for the bent rod and forming tools which press the bent rod against parts of the supporting mears to give the bent rod its desired final shape. There may be means, for example a chute arrangement or a roller conveyor arrangement, for feeding a bent rod from the first apparatus to the second apparatus. If necessary, there may be means for changing the orientation of the bent rod en rcute from the first apparatus to the second apparatus.

If desired, the second apparatus may have its supporting means in two units, there being means for separating one unit from the other after the clip has been finally shaped in the second bending operation, to allow the finished clip to fall from or otherwise be displaced from the zone in which the second bending operation was made.

For a better understanding of the invention and to show how it may be put into effect, reference will now be made, by way of example, to the accompanying drawings, in which:

FIGS. 1 and 2 show two views of an element which is a bent steel rod;

Figure 3A:
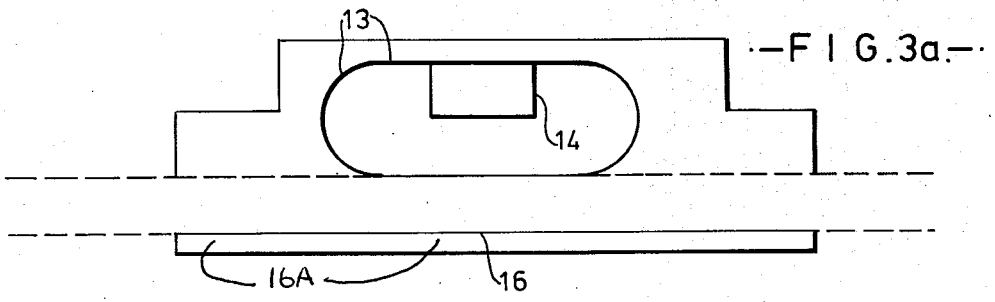
FIG. 3 shows an end view of a first bending apparatus for producing the element shown in FIGS. 1 and 2.
Figure 5:
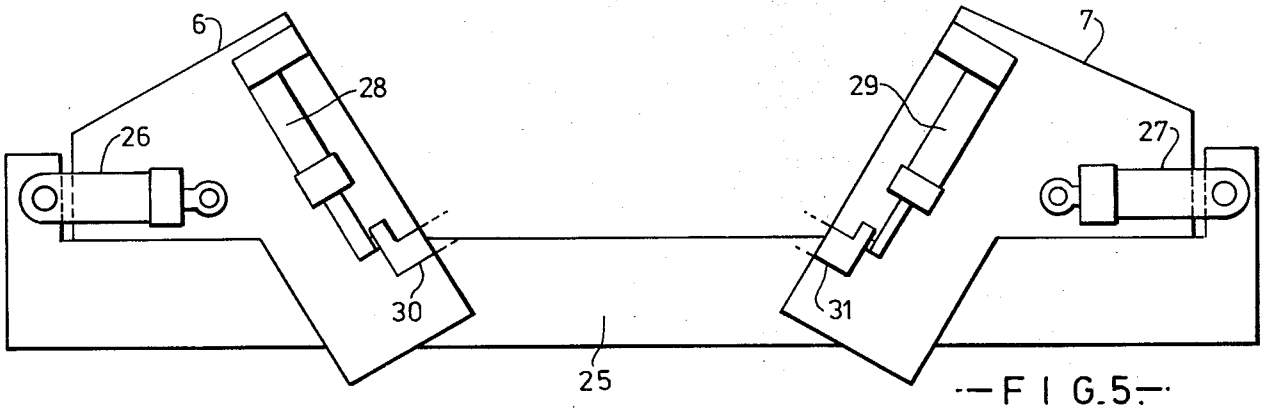
Figure 4:
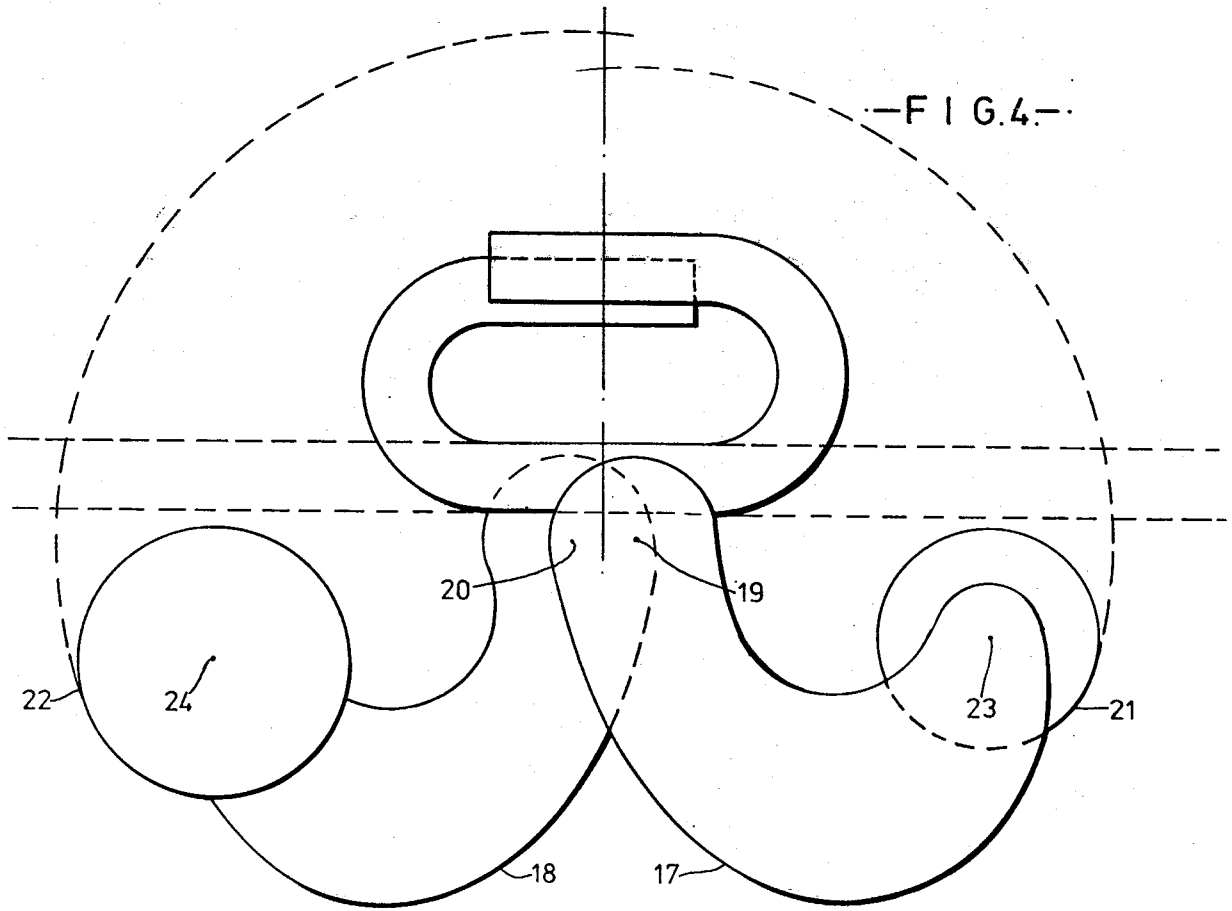

FIG. 3*a* shows a side view of a die shown in FIG. 3;

FIG. 4 shows a diagrammatic side view of other parts shown in FIG. 3;

FIG. 5 shows an end view of more parts of the apparatus of FIG. 3 which are not visible therein;

FIG. 6 shows a side view of an installation comprising a first bending apparatus as shown in FIGS. 3 to 5 and a second bending apparatus arranged to operate after the first bending apparatus;

FIG. 7 shows a plan view of parts of the installation of FIG. 6;

FIG. 8 shows a different view of a part shown in FIG. 7; and

FIG. 9 shows an end view of the part of FIG. 8 in the installation of FIG. 6.

The element shown in FIGS. 1 and 2 is made by bending a red-hot resilient steel rod of circular cross-section and a diameter of at least 0.8 centimeter. It has two ends A and B and, progressing from one end A to the other end B, a first portion 1 which is a substantially straight leg, a second portion 2 which is a reverse bend, a substantially straight third portion 3 which is substantially parallel to the first portion 1, a fourth portion 4 which is another reverse bend and a substantially straight fifth portion 5 which is substantially parallel to the first portion 1. Thus two U-bends are formed in the rod, the portion 3 remains substantially straight and constituting one limb of each U, the other limbs of the Us being the portions 1 and 5, the two limbs of each U having unequal lengths. The reverse bends 2 and 4 are made in two planes inclined to one another by about 65°. Thus in one orientation of the element it appears from one viewing point rather like a mirror image of a letter e, as shown in FIG. 1 (where the end A appears in front of the fourth portion 4), and in another orientation and from another viewing point it looks rather like a letter V, as shown in FIG. 2. One limb of the V is longer than the other because the radius of the bend 4 is greater than that of the bend 2. FIG. 1 shows that the end portions of the bent element overlap without touching one another. FIG. 2 shows that the lateral spacing between them is greater than the diameter of the rod.

The first bending apparatus comprises first and second carriages 6 and 7 (FIG. 3) which are associated with hydraulic cylinders (not shown in FIG. 3) for moving the carriages 6 and 7 in parallel opposite directions, i.e. carriage 6 to the left and carriage 7 simultaneously to the right and later carriage 6 to the right and carriage 7 simultaneously to the left. These carriages 6 and 7 carry bending dies 8 and 9 which are rigidly and removably connected to pillars 10 and 11 on the carriages 6 and 7 respectively. The dies 8 and 9 have forming surfaces 12 and 13, respectively, upon straight upper portions of which are to be formed the "fifth portion" 5 and the "first portion" 1, respectively, of the element. The dies 8 and 9 each have a curved end portion (not shown in FIG. 3) of the forming surface for forming the reverse bends 4 and 2, respectively, of the bent element.

Each of the dies 8 and 9 has a recess 14 in it and when the carriages 6 and 7 are moved towards one another a stationary member 15 suspended from above lies partly in each of the two recesses 14 and the carriages 6 and 7 have an end position when the surfaces defining the extremities of these recesses abut the member 15.

There are further recesses 16 in the dies 8 and 9 and these together provide a space to receive the red-hot steel rod entering the apparatus, a central part of this length being supported and gripped by the material of the dies at the boundaries of the recesses 16. This central part of the rod provides the "third portion" 3 of the element shown in FIGS. 1 and 2. The carriages 6 and 7 carry first and second substantially C-shaped arms 17 and 18, each of which is mounted at one end to turn about an axis, 19 or 20, respectively. Each arm 17 or 18 carries at its free end a roller, 21 or 22, the axis of rotation, 23 or 24, of which is parallel to the axis 19 or 20 respectively.

The distance between the axes 19 and 23 is equal to the distance between the axes 20 and 24. However, the roller 21 has a smaller diameter than the roller 22, and the straight upper portion of the surface 12 is higher than the straight upper portion of the surface 13, in order to allow for the greater distance between the portions 3 and 5, as compared with the portions 1 and 3, and the greater radius of the bend 4 as compared with the bend 2.

The bent element could differ from that shown in FIGS. 1 and 2 by having the portion 1 curved, with a large radius of curvature, and/or the portion 3 not parallel to the portion 1 and/or curved, with a large radius of curvature, and/or the portion 5 not parallel to the portion 1 and/or curved, with a large radius of curvature. The bends 2 and 4 could have the same radius of curvature, in which case the rollers 21 and 22 could be of the same diameter and the straight upper portions of the surfaces 12 and 13 could be on the same level. Another possibility is for the clip to be such that, in a view corresponding to that of FIG. 1, the clip looks rather like a letter e with the end A again appearing in front of the fourth portion 4.

FIG. 3*a* shows the forming surface 13 of the die 9 comprising to the left a curved portion, to define the reverse bend 2 of the element shown in FIGS. 1 and 2, and a straight portion to receive the "first portion" 1 of the bent element. The recess 16 has its lower extremity defined by a ledge 16A which extends beyond the left-hand and right-hand ends of the forming surface 13 to provide, with the corresponding ledge of the die 8, a trough to receive a straight rod (as shown in dotted lines in FIG. 3*a*) before a bending operation commences. The die 8 is the same as the die 9 except for its different dimensions to achieve the larger radius reverse bend. If desired the dies 8 and 9 can have portions which interengage when the dies are brought together.

FIG. 4 shows from the side and in dotted lines a rod in the position in which it is gripped by the dies 8 and 9 and lies partly in the recesses 16 prior to a bending process. A finished bent element is shown in solid lines as formed on the dies 8 and 9. The arms 17 and 18 and the rollers 21 and 22 are shown diagrammatically in solid lines in their positions prior to a bending stroke, and the paths of the rollers 21 and 22 during a bending stroke are shown in dotted lines. In FIG. 4 all the axes 19, 20, 23 and 24 are shown as being parallel for simplicity.

FIG. 5 shows the carriages 6 and 7, which slide along a bed 25, under control of hydraulic piston and cylinder devices 26 and 27 coupled to the carriages and to the bed 25. The machinery between the carriages has been omitted.

Further hydraulic piston and cylinder devices 28 and 29 housed in the carriages 6 and 7 are coupled each at its upper end to the carriage 6 or 7 and at its lower end via a crank and an axle 30 or 31 to the arm 17 or 18 to turn it.

FIG. 6 shows a first bending apparatus 32 as illustrated and described with reference to FIGS. 3 to 5, in such an orientation that a steel rod approaching the dies 8 and 9 does so in a direction extending downwardly from right to left, parallel to the lines representing the bed 25. The carriages 6 and 7, of which only the latter is visible, move perpendicularly to the plane of the drawing. The view shown in FIG. 3 is taken looking in the direction of the arrow 32*a*.

The apparatus 32 includes a gate 33 which can be raised, to allow a pre-cut straight and red-hot steel rod to approach the dies 8 and 9, and lowered to prevent approach of the next such rod. Beyond the dies 8 and 9 there is a retractable sensor 34 arranged so that the bottom end of a straight rod which has entered the recesses 16 in the dies will abut the sensor 34 and thus stop.

A cross-sectionally V-shaped downwardly-inclined chute 35 is arranged under the apparatus 32 to catch an element as shown in FIGS. 1 and 2 after it has been formed and released by the bending apparatus 32. At the bottom end of the chute 35 there is a turntable, V-shaped, open-ended box 36, to receive an element from the chute 35, and a fixed sensor 37, just beyond the box, mounted on a fixed plate 37*a*, whereby the bent element is prevented from sliding out of the box 36 and its presence there is sensed.

The bent element is transferred by gravity from the box 36 (in a manner to be described hereinafter) to a second bending apparatus comprising a die mounted on a two-part bed 38, 39 and further comprising a hydraulic press 40. The press 40 comprises a forming bend 41 which carries forming tools (not shown) and which comes down only once upon the element whilst the latter is still red-hot in the aforementioned die to bend the element in order to produce a finished rail-fastening clip. The die, the forming tools and the finished clip are as described and illustrated in British Patent Specification No. 1,497,908, except that in the present case the die is in two parts.

An hydraulic piston and cylinder device 42 is coupled to a movable part 39 of the two-part bed 38, 39 and can move the part 39 in the directions indicated by the arrows 43. The part 39 is shown fully retracted in the downward direction; normally it is in contact with the part 38.

FIG. 7 shows a view from above of the end of the chute 35, the V-shaped box 36 of FIG. 6 and the two-part die 46, 47 (not shown in FIG. 6), the parts 46 and 47 of which are mounted on the parts 38 and 39, respectively, of the bed. The V-shaped box forms part of a member 44 which can turn about an axis 45 to change the orientation of a bent element and transfer it to the die 46, 47.

A dividing line 48 is shown between the two parts 46 and 47 of the die. The fixed part 46 of the die includes a groove 49 down which the portion 1 of the bent element slides and the movable part 47 of the die includes a hole 50 into which the free end of the portion 1 slides until its free end abuts a sensor 51. The forming tools carried by the head 41 of the press 40 descend together and strike the portions 3 and 5 of the bent element, and possibly another member descends with them and holds the portion 1, so that the clip is given its desired final shape as described in relation to FIGS. 1 to 3 and 7 to 12 of British Patent Specification No. 1,497,908.

The fixed part 46 of the die carries a cylindrical plunger 52 which acts on the portion 1 of the finished clip to eject it from the fixed part 46 of the die after the fixed and movable parts 46 and 47 have separated after completion of a bending operation.

FIG. 8 shows in end view the box 36 on the member 44 and the axis 45.

FIG. 9 shows a view looking down the chute 35 of FIG. 6. The box 36 is shown in full lines in a right-hand position and in dotted lines in a left-hand position attained by turning the box about the axis 45 from the right-hand position. In its right-hand position it receives a bent element from the chute 35 with the portion 3 of the element in the bottom corner of the box 36 and the portion 1 of the element going into the top left hand corner of the box. After rotation of the member 44 through 120° about the axis 45 so that the box 36 goes into the illustrated left-hand position, the portion 1 of the element is now at the bottom corner and the portion 5 at the top left-hand corner and the element slides from the box 36 with the portion 1 going into the groove 49 and hole 50 in the die 46, 47 as described previously. Rapid rotation of the member 44 is achieved by a pneumatic piston and cylinder device 52A which turns the member 44 via gears. When the box 36 is in its left-hand position the end of the chute 35 is blocked by the member 44 and thus any bent element in the chute 35 is prevented from leaving the chute whilst the box 16 is not in position to receive it.

The two bending apparatuses operate as follows:

Initially the dies 8 and 9 in FIG. 3 are spaced further apart than FIG. 3 shows; the arms 17 and 18 are in the positions shown in FIG. 4. A steel rod enters the first bending apparatus via the open gate 33. The dies 8 and 9 do not initially grip it but are sufficiently close together in a "ready to clamp" position to guide it until it abuts the sensor 34. It then stops. The sensor causes the gate 33 to close and causes the hydraulic devices 26 and 27 to move the carriages 6 and 7 and with them the dies 8 and 9 together, to grip the rod in the recesses 16 and to abut the member 15. The sensor 34 retracts out of contact with the end of the rod. The hydraulic devices 28 and 29 operate to move the arms 17 and 18 simultaneously from their FIG. 4 position into the position shown in FIG. 3. The rod is thus bent into the shape shown in FIGS. 1 and 2.

Further sensors (not shown) detect when the arms 17 and 18 have reached their end position. After this the hydraulic devices 28 and 29 operate, to return the arms 17 and 18 into their FIG. 4 position, and the hydraulic devices 26 and 27 operate to draw the carriages 6 and 7 apart. The dies 8 and 9 part rapidly beyond the "ready to clamp" position and the bent element drops between them into the chute 35 with its portion 3 at the bottom of it. The sensor 34 returns to its initial position, the hydraulic devices 26 and 27 operate to return the carriages 6 and 7 into the "ready to clamp" position, and the gate 33 reopens, in preparation for the arrival of another rod.

The already bent element slides down the chute 35 into the triangular box 36 under the force of gravity and actuates the sensor 37 which initiates operation of the device 52A so that the bent element passes to the second bending apparatus as described above.

The sensor 51 detects that the bent element is in position in the die of the second bending apparatus and causes the press 40 to operate. Its forming tools descend and then rise again and the hydraulic device 42 withdraws rapidly the bed part 39 (and with it the part 47 of the die) into the position shown in FIG. 6. The plunger 52 ejects the finished clip from the fixed part 46 of the die and the finished clip falls between the parts 46 and 47 and between the parts 38 and 39 into a quenching bath. The hydraulic device 42 returns the parts 39 and 47 to reclose the die 46, 47, and the device 52A returns the triangular box 36 into alignment with the chute 35. The second bending apparatus is now ready to receive the next bent element, which may already be in position at the bottom of the chute 35.

The invention extends to the product of the first bending apparatus and method, and also to the product of the whole installation and operation.

We claim:

1. Apparatus for use in making railway rail-fastening clips comprising support means capable of supporting a part of a red-hot metal rod, which part is between the ends of the rod, first and second supports, first and second members mounted on the first and second supports, respectively, first and second forming surfaces on the first and second members, respectively, first and second displaceable bending members mounted on the first and second supports, respectively, means for displacing the bending members relative to the first and second forming surfaces, respectively, so that they bend the parts of the rod on both sides of said part about the first and second forming surfaces, respectively, and produce two U-bends in the rod, substantially without movement of said part of the rod, with the result that the end portions of the rod point in substantially opposite directions and overlap without touching one another and means for producing relative motion between the supports so that they come apart to allow the bent rod to move away from the zone in which it was bent.

2. An apparatus according to claim 1, in which the displacing means are operable to displace as aforesaid the first and second bending members simultaneously.

3. An installation for use in making railway rail-fastening clips comprising a first apparatus comprising support means capable of supporting a part of a redhot metal rod, which part is between the ends of the rod, first and second supports, first and second members mounted on the first and second supports, respectively, first and second forming surfaces on the first and second members, respectively, first and second displaceable bending members mounted on the first and second supports, respectively, means for displacing the bending members relative to the first and second forming surfaces, respectively, so that they bend the parts of the rod on both sides of said part about the first and second forming surfaces, respectively, and produce two U-bends in the rod, substantially without movement of said part of the rod, with the result that the end portions of the rod point in substantially opposite directions and overlap without touching one another and means for producing relative motion between the supports so that they move apart to allow the bent rod to move away from the zone in which it was bent, and said installation further comprising a second apparatus for performing a second bending operation on the rod.

4. An installation according to claim 3, wherein the second apparatus comprises supporting means for the bent rod and forming tools for pressing the bent rod against parts of the supporting means to give the bent rod its desired final shape.

5. An installation according to claim 4, in which the second apparatus has its supporting means in two units, there being means for separating one unit from the other after the clip has been finally shaped in the second bending operation, to allow the finished clip to fall from or otherwise be displaced from the zone in which the second bending operation was made.

6. An installation according to claim 3 wherein the second apparatus is at a lower level than the first apparatus and the installation is such that the bent rod can travel from the first apparatus to the second apparatus under the force of gravity.

7. An installation according to claim 3, and comprising, in a path of travel of the bent rod from the first apparatus to the second apparatus, means for altering the orientation of the bent rod from a first predetermined orientation to a second predetermined orientation.

8. An installation according to claim 7, wherein the orientation altering means comprises a holder to receive the bent rod from the first apparatus, the holder having means for altering its orientation prior to the bent rod leaving the holder to travel to the second apparatus.

9. A method of making a railway rail-fastening clip including supporting a part of a red-hot metal rod, which part is between the ends of the rod, and displacing first and second bending members relative to first and second forming surfaces, respectively, so that they bend the parts of the rod on both sides of said part about said first and second forming surfaces, respectively, substantially without movement of said part of the rod, with the result that two U-bends are formed in the rod, said part remaining substantially straight and constituting one limb of each U, and the end portions of the rod point in substantially opposite directions and overlap without touching one another and are spaced apart laterally by a distance greater than the thickness of the rod.

10. A method according to claim 9 in which the first and second bending members are displaced as aforesaid simultaneously.

11. A method of making a railway fastening clip as claimed in claim 11, wherein: the other limb of at least one of the U's is substantially straight and substantially parallel to said part.

12. A method according to claim 9, in which the first and second forming surfaces are on two separate members at least one of which is moved away from the other to allow the bent rod to fall, or otherwise be displaced, away from the zone in which it was bent.

13. A method according to claim 12, in which the two members are mounted on separate carriages which are moved apart, the carriages also carrying the displaceable bending members.

14. A process for making a railway rail-fastening clip comprising a first method carried out in a first zone and including supporting a part of a red-hot metal rod, which part is between the ends of the rod, and displacing first and second bending members relative to first and second forming surfaces, respectively, so that they bend the parts of the rod on both sides of said part about said first and second forming surfaces, respectively, substantially without movement of said part of the rod, with the result that two U-bends are formed in the rod, said part remaining substantially straight and constituting one limb of each U, and the end portions of the rod point in substantially opposite directions and overlap without touching one another and are spaced apart laterally by a distance greater than the thickness of the rod and said process further comprising, subsequent to the first method, a second bending method performed on the rod at a second zone.

15. A process according to claim 14, wherein the second method comprises pressing the bent rod, by forming tools, against parts of a supporting means to give the bent rod its desired final shape.

16. A process according to claim 15, wherein said supporting means is in two units which are separated one from the other after the clip has been finally shaped in the second method, to allow the finished clip to fall from or otherwise be displaced from the second zone.

17. A process according to claim 14, wherein said second zone is at a lower level than the first zone and the bent rod travels from the first zone to the second zone under the force of gravity.

18. A process according to claim 14, wherein the orientation of the bent rod is altered from a first predetermined orientation to a second predetermined orientation during its travel from the first zone to the second zone.

19. A process according to claim 18, wherein the alteration of the orientation of the bent rod is performed by a holder which receives the bent rod from the first zone and has its orientation altered before the bent rod travels from the holder to the second zone.

20. A process for making a railway fastening clip as claimed in claim 14, comprising: forming the other limb of at least one of the U's substantially straight and substantially parallel to said part.

* * * * *

UNITED STATES PATENT AND TRADEMARK OFFICE

CERTIFICATE OF CORRECTION

PATENT NO. : 4,300,380

DATED : November 17, 1981

INVENTOR(S) : Peter E. Checkley

It is certified that error appears in the above-identified patent and that said Letters Patent are hereby corrected as shown below:

Column 1, line 16, insert a comma after "respectively"; line 29, for "bend" read --bent--; lines 48/49, delete "and are spaced apart laterally by a distance greater than the thickness of the rod". Column 2, line 15, for "mears" read --means--; line 21, for "rcute" read --route--; line 63, after "Thus" insert a comma; line 64, for "remains" read --remaining--; line 66, for "Us" read --U's--; line after the comma insert --and--. Column 4, line 59, for "turntable" read --turnable--. Column 5, line 1, for "bend" read --head--. Column 7, line 8, for "redhot" read --red-hot--. Column 8, line 8, for "fastening" read --rail-fastening--; line 9, for "11" read --9--; line 63, for "fastening" read --rail-fastening--.

Signed and Sealed this

*Eighth* Day of *November 1983*

[SEAL]

*Attest:*

GERALD J. MOSSINGHOFF

*Attesting Officer*

*Commissioner of Patents and Trademarks*